United States Patent [19]

Berkowitz

[11] Patent Number: 4,598,563

[45] Date of Patent: Jul. 8, 1986

[54] CYLINDER LOCK

[76] Inventor: Nathan L. Berkowitz, 4762 N. Cumberland Blvd., Milwaukee, Wis. 53211

[21] Appl. No.: 627,114

[22] Filed: Jul. 2, 1984

[51] Int. Cl.[4] ..... E05B 29/04

[52] U.S. Cl. ..... 70/364 R; 70/375; 70/377; 70/452

[58] Field of Search ..... 70/364 R, 452, 377, 70/372, 392, 375, 376, 352

[56] References Cited

U.S. PATENT DOCUMENTS

| | | | |
|---|---|---|---|
| 1,218,065 | 3/1917 | Diesel | 70/364 R |
| 1,644,092 | 10/1927 | Shinn | 70/364 R |
| 1,987,735 | 1/1935 | Falk | 70/364 R |
| 3,263,461 | 8/1966 | Tartaglia | 70/364 R |
| 3,555,859 | 1/1971 | Berkowitz | 70/340 |
| 4,052,870 | 10/1977 | Degeye et al. | 70/364 R |
| 4,237,712 | 12/1980 | Cramer | 70/452 X |
| 4,316,371 | 2/1982 | Del Nero | 70/452 X |
| 4,326,396 | 4/1982 | Steinbach | 70/364 R |
| 4,328,690 | 5/1982 | Oliver | 70/380 X |

FOREIGN PATENT DOCUMENTS

| | | | |
|---|---|---|---|
| 497699 | 11/1953 | Canada | 70/364 R |
| 924515 | 4/1963 | United Kingdom | 70/364 R |

*Primary Examiner*—Robert L. Wolfe
*Assistant Examiner*—Lloyd A. Gall
*Attorney, Agent, or Firm*—Bayard H. Michael

[57] ABSTRACT

The cylinder lock has a key guide which has a cylindrical extension fitting inside a cylindrical shell. A number of tumblers fit in the tumbler plug which is mounted inside the extension so the lock tab on each tumbler can project through a slot in the extension into one of two lock grooves inside the shell. The cam surface on the proper key will move the lock tabs out of the groove so the key guide and the plug and the tumblers can rotate in unison inside the shell. The tumbler plug engages a bolt driver which is journaled in and projects rearwardly from the shell. The projecting portion is threaded and has a squared portion on which a bolt is mounted and retained by a nut threaded on the threaded portion. The shell is threaded and also has opposed flats registering and lock relative to a bracket which enables mounting the lock on the rear of a door with an escutcheon plate on the front of the door. Bolts project from the rear of the escutcheon plate through holes in the door and in the bracket for retention by nuts. With such an arrangement the lock is protected behind the escutcheon plate to prevent the key being removed in the unlocked position.

4 Claims, 9 Drawing Figures

CYLINDER LOCK

BACKGROUND OF THE INVENTION

My U.S. Pat. No. 3,555,859 shows a cylinder lock which eliminated the coil springs typical of the prior art. This effected a considerable cost reduction. The present invention improves upon my patented design by providing smoother operation and greater strength. The invention also provides a more versatile mounting for cylinder locks of this type.

SUMMARY OF THE INVENTION

An object of this invention is to provide a cylinder lock mechanism in which the key guide has a cylindrical extension receiving the tumbler plug in alignment with opposed, axially extending slots through which the tumbler tongues project for engagement with the locking grooves in the cylindrical shell. The tumblers include resilient arcuate arms which bias the tongues into locking engagement with the grooves. The arms bear against the inside of the cylindrical extension of the key guide. Since the key guide and the tumblers rotate in unison there is no rubbing or drag as the lock is worked. The required force is greatly reduced and "feel" is much better. And, since there is no rubbing wear is reduced and life increased.

Another feature of this invention is novel construction of the shell enabling the lock to be mounted on a door a number of ways. The invention also extends the plug from the rear of the shell enabling a locking bar or a latch to be mounted on the lock.

DETAILED DESCRIPTION OF THE DRAWINGS

Figure 4:
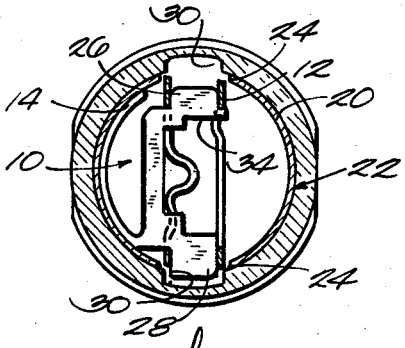
FIG. 4 is a vertical section taken on line 4—4 in FIG. 2.

The lock shown in the drawings is provided with tumblers 10 which fit inside of and are guided by the plug 12. Each tumbler has an integral spring arm 14 which projects through a cooperating aperture 16 or 18 in the plug to bear on the inside of the cylindrical extension or sleeve portion 20 of the key guide 22. The cylindrical extension 20 has opposed slots 24 aligned with the tabs 26, 28 projecting from opposite ends of each tumbler. The tabs 26, 28 project into grooves 30, 30 in the housing or shell 32. When the proper key is inserted in the shaped keyway 23 on the front of the guide 22 the cam surface on the key will act against surfaces 34 of a typical tumbler to pull the tongue 28 (FIG. 4) out of groove 30 but not move the tab 26 far enough to project into groove 30 aligned therewith. This frees the tumbler from the shell so the tumbler plug 12 and the key guide 22 can rotate as a unit inside of shell 32. Further details of this type of actuation can be seen in my U.S. Pat. No. 3,555,859 mentioned above.

Figure 1:
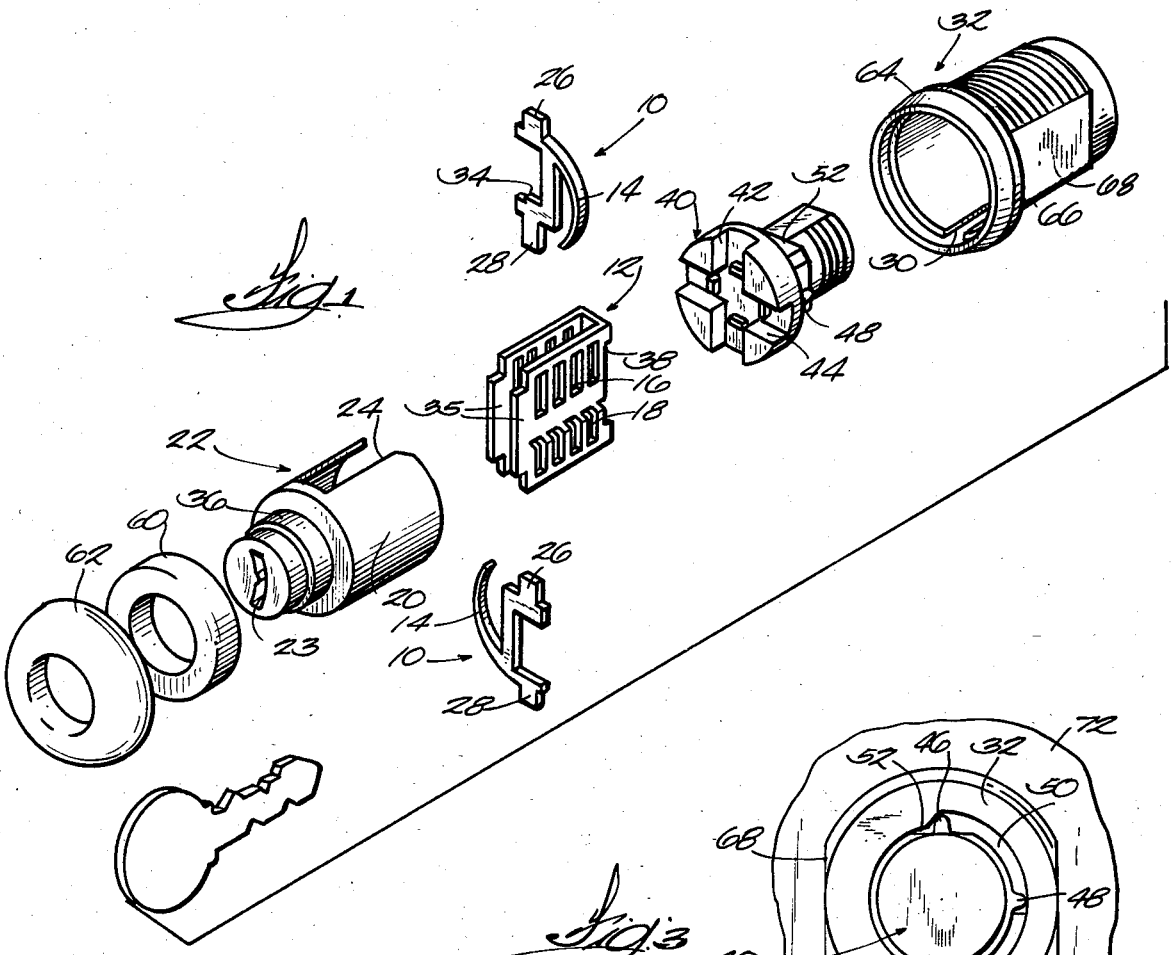
FIG. 1 is an exploded perspective view of the lock assembly.
Figure 3:
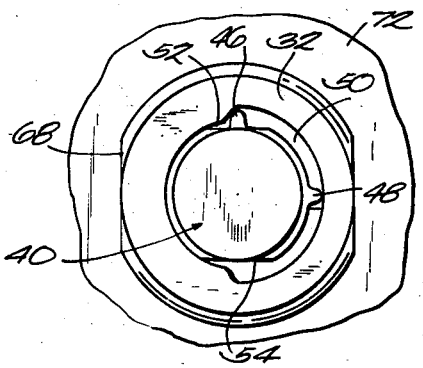
FIG. 3 is a section taken on line 3—3 of FIG. 2.
Figure 2:
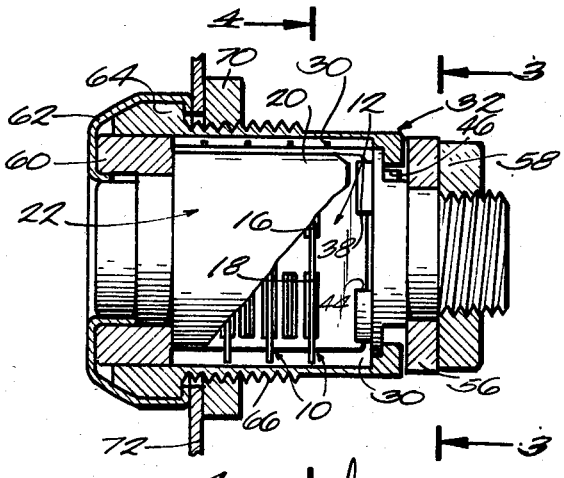
FIG. 2 is a vertical section through the lock.
Figure 5:
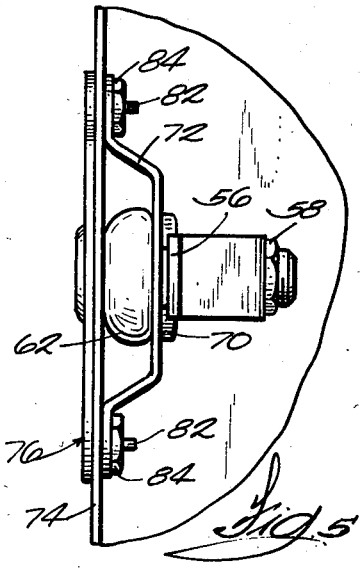
FIG. 5 is a side elevation showing the lock mounted on a door.

The left-hand side (FIGS. 1 and 2) of the plug 12 has parallel projections 35 which fit inside the smaller diameter portion 36 of the key guide to pilot and position the (left) end of the plug relative to the key guide. The right side or end of the plug is notched at 38 to fit over the end of bolt driver 40 while fitting inside of one of the cross slots 42, 44 in the driver. This makes a driving connection from the plug to the driver. The bolt driver is journaled in and projects through the end of the shell 32 with the lugs 46, 48 received inside the arcuate slot 50 in the end of the shell 32. The slot 50 extends over about 90° to limit rotation of the tumbler and key guide to movement between the position illustrated in FIG. 3 in which lug 46 hits the end of the slot, and the position in which lug 48 hits the other end of the slot 50. The portion of the bolt driver 40 projecting through the end of the shell has opposed flats 52, 54. A latch bolt 56 (FIGS. 5 and 6) having a square opening fits over the opposed flats to be driven by the bolt driver 40 between the locked position shown in FIG. 6 and the unlocked position in which the bolt would be turned upright. The bolt is held on the driver 40 by nut 58.

The left or front portion of the key guide can be fitted with a spacer 60 and then rose 62 is fixed on the nose and rolled over the shoulder 64 on the front of the shell 32. This captures the spacer. The rear portion of the shell 32 is threaded at 66 and has opposed flats 68. The threads permit a nut 70 to be turned down on the shell from behind to capture a bracket or mounting plate 72 between the nut and the inturned rear of the rose 62. The plate 72 is preferably provided with a central aperture having opposed flats corresponding to those on the shell so the bracket will be fixed relative to the shell or vice versa.

Figure 6:
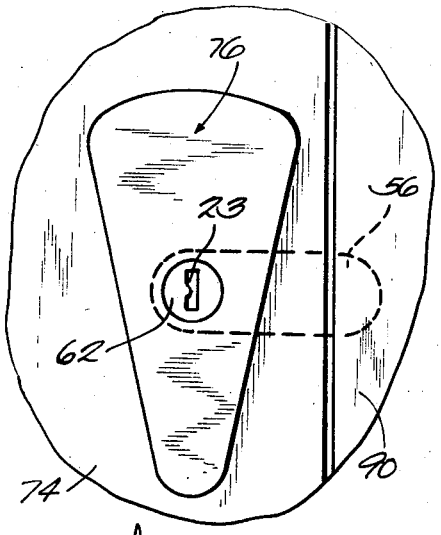
FIG. 6 is a front elevation showing how the lock is mounted on a door so the latch can enter the keeper (or the latch can simply lie behind the frame).
Figure 7:
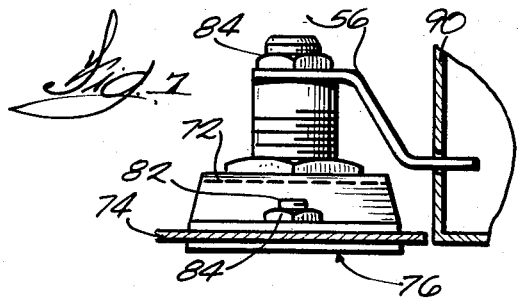
FIG. 7 is a horizontal section through FIG. 6.
Figure 8:
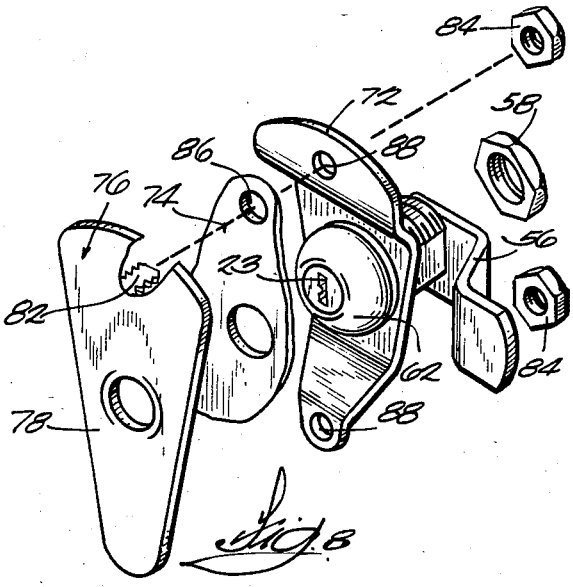
FIG. 8 is an exploded perspective view of the structure depicted in FIG. 5.
Figure 9:
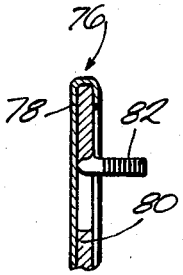
FIG. 9 is an enlarged detailed section showing the construction of the pseudo bolts.

The bracket 72 is utilized in mounting the lock assembly on the back of a door 74 with the blank cover or escutcheon plate 76 on the front of the door. The cover plate 76 is made up of two parts; one being a cosmetic cover 78 which is rolled onto the heavy duty piece 80 from which the tabs 82 are bent rearwardly and then provided with "threads" permitting the nuts 84 to be turned down on the formed pseudo bolts 82 which pass through corresponding holes 86 in the door and through the holes 88 in mounting plate 72. This mounts the rose 62 behind the door which affords maximum protection to the lock. As can be seen in FIGS. 6 and 7, the deadbolt 56 is received in the opening in the fixed jamb 90 of the cabinet frame to lock the door. To unlock the door the key must be inserted and rotated to rotate the deadbolt counter-clockwise from the FIG. 6 position to clear the jamb or doorframe 90. Since the key can't be removed with the deadbolt in the unlocked position the key becomes the handle and the key is pulled to open the door.

Since the plug engages the bolt driver 40 in either of two 90° positions and since the deadbolt can be mounted on flats 52, 54 on the rear of the deadbolt driver to project either direction, virtually any actuation can be obtained. The design is very versatile. The plug spring arms 14 bear against the interior of the sleeve 20 of the key guide. Therefore, there is no rubbing and, therefore, the action is very smooth. Spring arm wear has been eliminated with this design.

It will be apparent that instead of mounting the lock on the door or cabinet by means of the bracket 72, the rose 62 could be mounted on the front of the door with the door captured between the rose and the nut 70 just as the bracket is captured in that space. The shape of the deadbolt 56 can be varied to meet the various mounting requirements. If the lock is designed so the key can only be removed when the lock is locked, the key becomes the door handle when the lock is mounted on the rear of the door as shown.

I claim:

1. A cylinder lock comprising, a shell having a generally cylindrical interior, a key guide having a cylindrical extension sleeve fitting inside said shell, said shell having diametrically opposed locking grooves, said guide extension sleeve having diametrically opposed slots generally in register with said grooves, a tumbler plug mounted in said extension sleeve, a plurality of tumblers mounted in a guided by said plug for movement between a locked position in which the tumblers project through said slots into said grooves and an unlocked position in which the tumblers do not engage said grooves, spring means biasing each of said tumblers to said locked position, said spring means comprising an integral arcuate arm on each tumbler, each arm projecting between said plug and said extension sleeve and having a curvature similar to the interior of said extension sleeve, each arm bearing against the interior of said extension sleeve and being flexed when the tumbler is moved, a bolt driver rotatably mounted in said shell, and means connecting said plug to said bolt driver.

2. A cylinder lock according to claim 1 in which said key guide has a keyway on the end opposite said bolt driver.

3. A cylinder lock according to claim 2 in which said bolt driver is threaded and has a flat for driving and registration purposes, the portion of the driver connected to said tumbler plug being connected to said plug to orient said flat in either of two planes at 90° to each other.

a bolt having an opening complementing the shape of the threaded portion of said driver and mounted on said driver.

and a nut threaded on said driver for retaining said bolt on said driver.

4. The cylinder lock of claim 1 mounted on the rear of a door having an aperature aligned with said key guide, a mounting plate mounted on said shell, a cover plate on the front of said door and having an opening aligned with said door aperture, spaced threaded mounting bolts projecting through said door from the rear of said cover plate, said bolts being inaccessible from the front of said cover plate, holes in said mounting plate receiving said mounting bolts, and nuts threaded on said mounting bolts to fix said mounting plate and the lock on the rear of said door.

* * * * *